US006098910A

United States Patent [19]

Slezak

[11] Patent Number: 6,098,910

[45] Date of Patent: Aug. 8, 2000

[54] SELF-COMPENSATING FILAMENT TENSION CONTROL DEVICE

[75] Inventor: Raymond J. Slezak, Barberton, Ohio

[73] Assignee: Wayne-Dalton Corp., Mt. Hope, Ohio

[21] Appl. No.: 09/151,552

[22] Filed: Sep. 11, 1998

[51] Int. Cl.[7] ..... B65H 23/06

[52] U.S. Cl. ..... 242/421; 242/421.5; 242/421.8; 242/421.9; 242/422.4; 242/597.6; 188/74; 188/170

[58] Field of Search ..... 242/421, 421.5, 242/421.8, 421.9, 422.4, 597.6; 188/74, 170, 29, 106 F

[56] References Cited

U.S. PATENT DOCUMENTS

| | | | |
|---|---|---|---|
| 724,975 | 4/1903 | Wardwell . | |
| 1,031,487 | 7/1912 | Taylor . | |
| 1,100,039 | 6/1914 | Tyler et al. . | |
| 1,103,144 | 7/1914 | Hunting | 242/421.9 |
| 1,395,830 | 11/1921 | Jones | 242/421.9 |
| 1,462,604 | 7/1923 | LaValle . | |
| 1,475,855 | 11/1923 | Murdock . | |
| 1,640,532 | 8/1927 | Coldwell | 242/422.4 X |
| 1,946,313 | 2/1934 | Daniels | 242/156 |
| 2,149,940 | 3/1939 | Kylin | 188/74 X |
| 2,472,548 | 6/1949 | Schnell | 242/75 |
| 2,766,945 | 10/1956 | Reich | 242/45 |
| 2,879,011 | 3/1959 | Nelson | 242/156.2 |
| 2,983,468 | 5/1961 | Perrella | 242/156.2 |
| 3,076,618 | 2/1963 | Van Hook | 242/75.42 |
| 3,081,957 | 3/1963 | Van De Bilt | 242/54 |
| 3,182,961 | 5/1965 | Le Bus, Sr. | 242/421.8 |
| 3,223,352 | 12/1965 | Fuller et al. | 242/156.2 |
| 3,355,122 | 11/1967 | Thatcher | 242/75.43 |
| 3,731,889 | 5/1973 | Alexeff | 242/156.2 |
| 3,899,143 | 8/1975 | Slezak | 242/156.2 |
| 4,004,750 | 1/1977 | Seagrave, Jr. | 242/421 |
| 4,139,165 | 2/1979 | Dyck | 242/421 |
| 4,664,232 | 5/1987 | Takagi et al. | 188/74 |
| 5,314,136 | 5/1994 | Vaida et al. | 242/421.8 |

FOREIGN PATENT DOCUMENTS 09086790 3/1997 Japan .

*Primary Examiner*—Donald P. Walsh
*Assistant Examiner*—Minh-Chau Pham
*Attorney, Agent, or Firm*—Renner, Kenner, Greive, Bobak, Taylor & Weber

[57] ABSTRACT

A tension control device (10) for regulating the payout of filamentary material (24) from a spool (22) includes a fixed support (12, 14), a swing frame assembly (16) pivotably mounted on the fixed support and predisposed to a holding position, and a spindle assembly (20) carried by the swing frame assembly. The spindle assembly (20) carries the spool (22) and rotates with the spool as the filament is pulled off the spool. A braking assembly (18) is pivotably mounted on the fixed support (14) and is movable with the swing frame assembly (16). A cam (30) is fixably mounted on the fixed support and bears against the braking assembly (18) and forces the braking assembly to control the rotation of the spindle assembly. A pull-off force applied by filamentary material causes the swing frame assembly to move away from the holding position and allows rotation of the spindle assembly. A loading assembly fixably mounted on the fixed support positions the swing frame assembly and the braking assembly to a holding position that must be overcome by tension applied by the filament in order for the spool to begin rotation.

17 Claims, 5 Drawing Sheets

SELF-COMPENSATING FILAMENT TENSION CONTROL DEVICE

TECHNICAL FIELD

The present invention relates generally to an automatic tension control device for regulating the amount of tension under which a filamentary material is withdrawn from a spool. More particularly, the present invention relates to such a tension control device which tends to maintain substantially constant tension in filamentary materials over variances in operating parameters. More specifically, the present invention relates to such a tension control device which employs a suspended spindle operative with a cam-actuated brake assembly, thereby tending to maintain substantially constant tension in a filament without oscillation under adverse operating conditions.

BACKGROUND ART

Filamentary materials include fibers in single and multiple strands, flat bands, or tubing produced in long lengths and conveniently wound on spools. The various filamentary materials may be either natural or synthetic fibers, glass or metal. Such materials are commonly utilized as reinforcements for plastic or elastomeric compounds or may themselves be fabricated into integral items as in the textile industry. Regardless of the application, it is customary to withdraw the filamentary material from the spool at or near the location it is being used. To facilitate such removal, the spool is customarily mounted on a spindle or let-off device which permits the spool to rotate as the filament is withdrawn.

Because payout of the filament from the spool may be at a high linear velocity, thereby imparting substantial momentum to the spool and related spindle mounting components, it is necessary to dissipate force rapidly in the event the filament breaks or the take-up velocity suddenly decreases. In either situation, filament tends to be payed out more rapidly than it is needed until rotation of the spool can compensate. Obviously, the problem is greatly multiplied when a creel assembly carrying up to several hundred spools is being used. Numerous braking devices have been developed for use with creels. Many of these provide for the filament to be payed out under tension greater than what is required for payout from the spool. As the tension decreases, with slack in the filament, the braking force is applied to slow the rotation of the spool. Further, the amount of tension to be maintained in the filament must be variable in order to accommodate operations with different filaments under various conditions. In the past, such creels having variable tension control have often required multiple individual adjustments and have not been desirably compact. Some designs have even required tension adjustments during payout of the filament, as the spool is emptied. In other instances, creels have exhibited undesirable hunting or loping in the form of periodic variations about a desired tension, particularly in high-tension applications.

One of the more commercially successful tension control devices used in the tire industry is in accordance with Applicant's U.S. Pat. No. 3,899,143. That device has a support structure which carries a spool support and a separately mounted rotatable pivot shaft. A first lever arm fixed on the pivot shaft carries a guide for tensioning the filamentary material as it is withdrawn from a spool mounted on the spool support and a brake which selectively engages the spool support. A second lever arm fixed on the pivot shaft is operatively connected with an air cylinder which effects a biasing that is transmitted to the first lever arm via the pivot shaft.

Tension control devices according to U.S. Pat. No. 3,899,143 have demonstrated exemplary operating characteristics under a variety of conditions and with a variety of filaments. However, there are several situations in which these tension control devices are not well suited. It has been found that the control arm and guide roller are vulnerable to damage from over-tension possibly caused by entanglement of the spooled material. In instances where the filamentary material is a heavy gauge wire, the guide roller imparts a "cast" or distortion to the shape of the wire. This may lead to a less than satisfactory end product or the need to provide additional manufacturing equipment to straighten the wire. To the present time, there has been no comprehensive device for dispensing heavy filamentary material from a spool. Yet a third problem is that the control arm and roller inhibits closely mounting the multiple tension controllers on the creel assembly.

DISCLOSURE OF INVENTION

It is, therefore, an object of the present invention to provide a tension control device for filamentary material which provides for payout of a filamentary material at a uniform tension selected from a substantial range, irrespective of the rate at which the filament is taken up. It is another object of the present invention to provide such a tension control device which maintains substantially uniform tension on the filamentary material during payout, irrespective of the amount of filamentary material remaining on a spool. It is a further object of the present invention to provide such a tension control device which is relatively compact and readily adjusted so as to accommodate various heavy filamentary materials.

It is yet another object of the present invention to provide a tension control device for filamentary material which may be selectively loaded by a loading device to provide any desired tension setting over an operating range covering the applications for a particular device constructed according to the invention.

It is a further object of the present invention to provide a tension control device that does not impart a distortion to the filamentary material as it is withdrawn from a spool. It is still another object of the present invention to provide a predetermined threshold to the loading device which applies a braking force to the rotation of the spool that can only be overcome by a tension force applied by the filamentary material.

It is another object of the present invention to provide a tension control device in which the spool is carried by a pivotably mounted spindle assembly that is movable with a pivotably mounted braking assembly. It is still another object of the present invention to provide a fixed cam that engages the braking assembly and inhibits rotation of the spindle assembly whenever a predetermined tension force is absent from the filamentary material. A further object of the present invention is to provide the braking assembly with a slidable block with cam bearings that are spring-biased against a curvilinear cam surface provided by the cam to provide a gradual yet firm application or removal of braking force. It is still another object of the present invention to construct the interrelationship between the cam and the braking assembly so that as the diameter of the wound filamentary spool decreases, the tension force acting on the spindle and braking assemblies causes the braking force to be relieved by an increasing amount, thereby tending to keep the filament tension constant.

It is still another object of the present invention to provide such a tension control device which may be combined with a plurality of such devices wherein the tension setting for the devices may be readily varied remotely by a single adjustment.

At least one or more of the foregoing objects of the present invention, together with the advantages thereof over existing and prior art forms of filament tension control devices which will become apparent from the following description, are accomplished by the invention hereinafter described and claimed.

In general, the present invention contemplates a tension control device for regulating the payout of filamentary material from a spool, including a fixed support, a swing frame assembly pivotably mounted on the fixed support and predisposed to a holding position, a spindle assembly carried by the swing frame assembly, the spindle assembly carrying the spool and rotating with the spool as the filament is pulled off the spool, a braking assembly pivotably mounted on the fixed support and movable with the swing frame assembly, a cam fixably mounted on the fixed support and bearing against the braking assembly and forcing the braking assembly to control the rotation of the spindle assembly wherein a pull-off force applied by filamentary material causes the swing frame assembly to move away from the holding position and allow rotation of the spindle assembly, and a loading assembly fixably mounted on the fixed support for positioning the swing frame assembly and the braking assembly to the holding position.

PREFERRED EMBODIMENT FOR CARRYING OUT THE INVENTION

Figure 1:
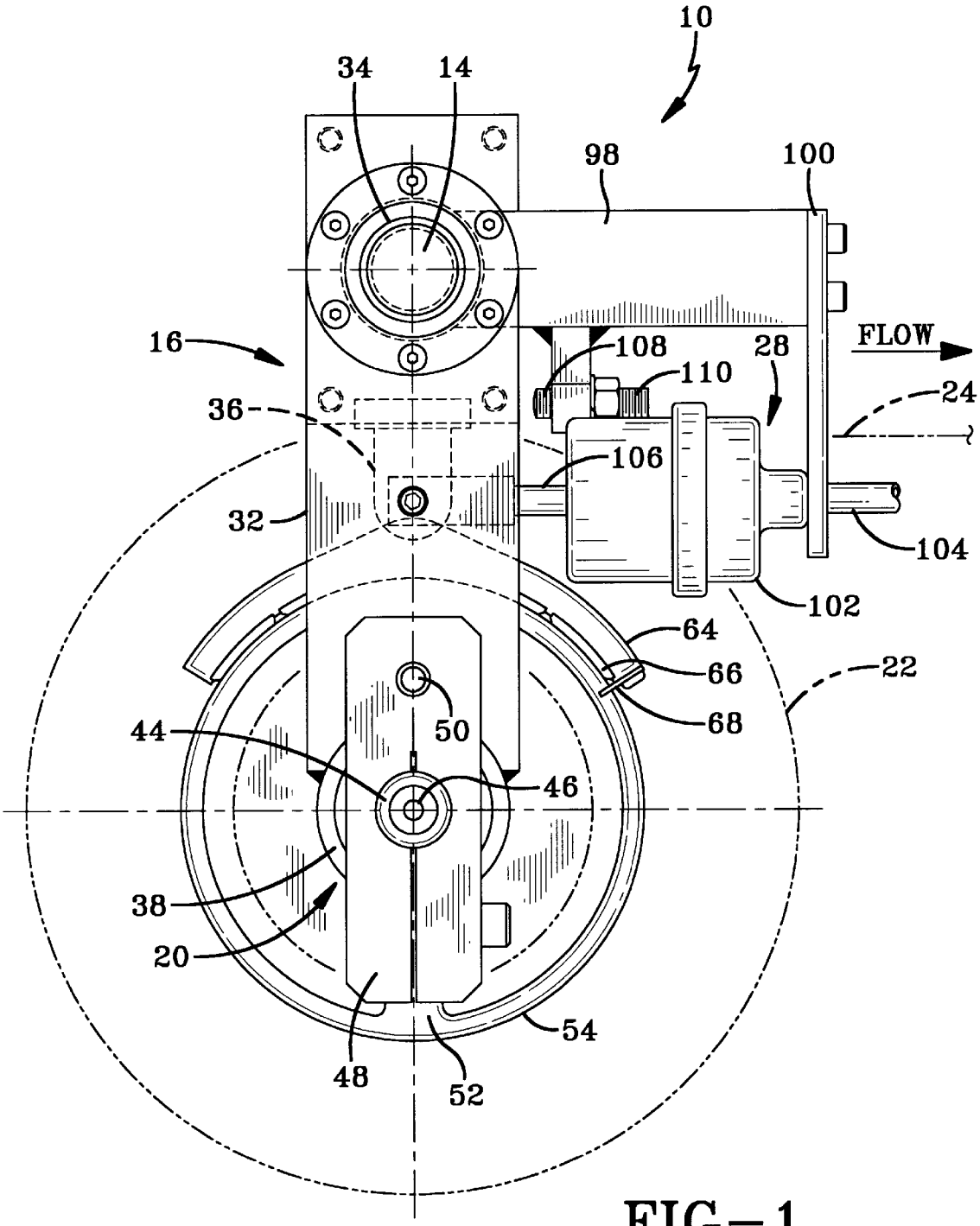
FIG. 1 is a front-elevational view of a self-compensating filament tension control device, embodying the concepts of the present invention, wherein a spool of filamentary material is shown in phantom and wherein the device controls rotation of the spool.
Figure 6:
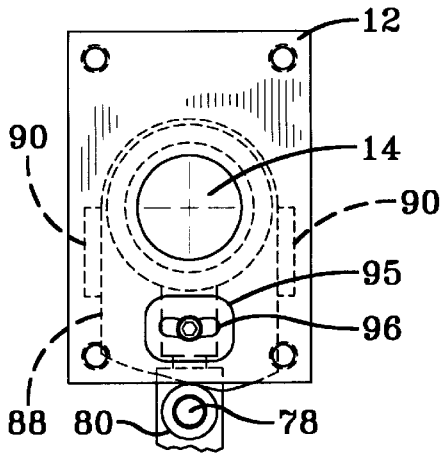
FIG. 6 is a side view of the device taken substantially along line 6—6 of FIG. 2.
Figure 2:
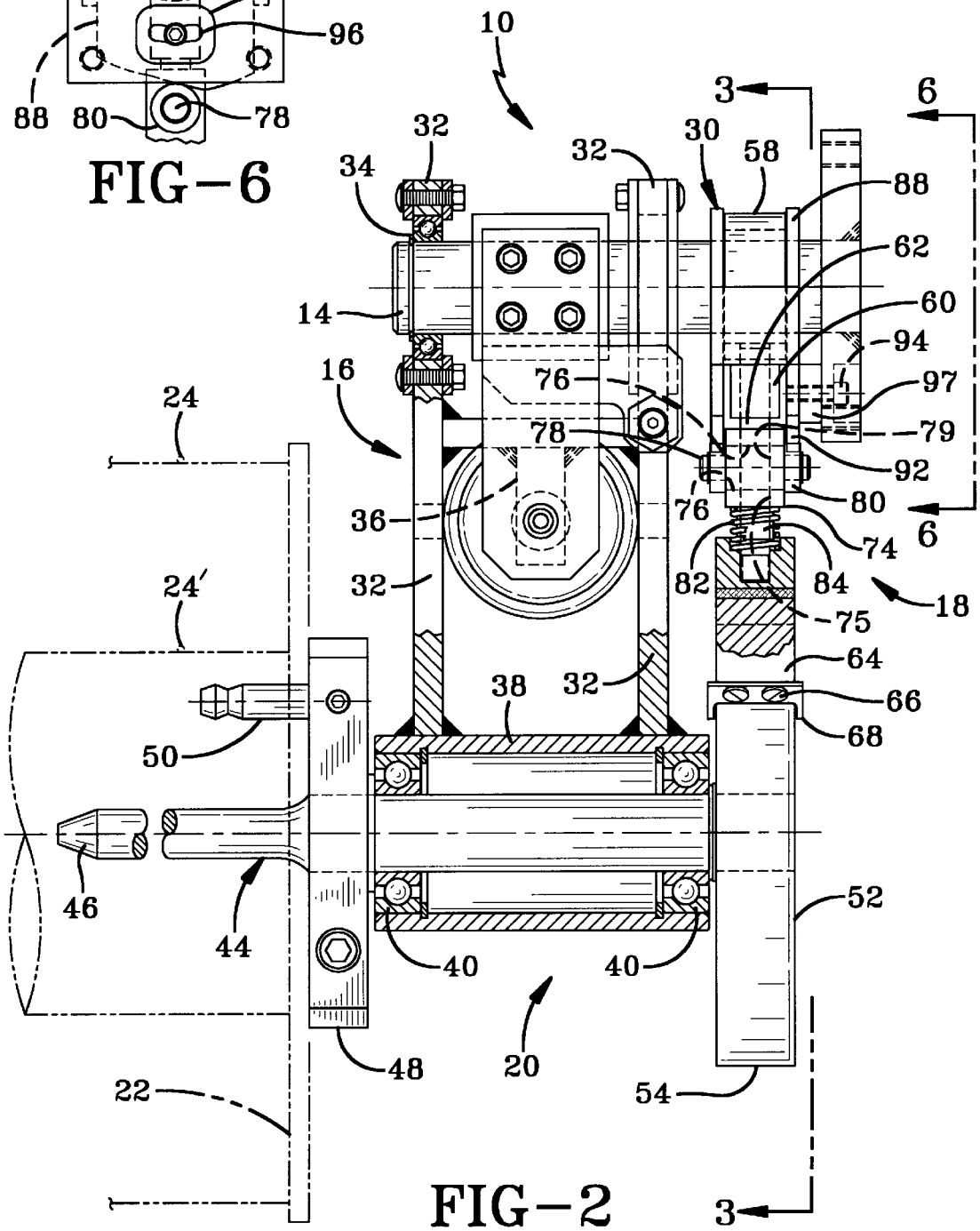
FIG. 2 is a fragmentary, side-elevational view with portions broken away, showing selected elements in section depicting details of a swing frame assembly and a braking assembly.
Figure 3:
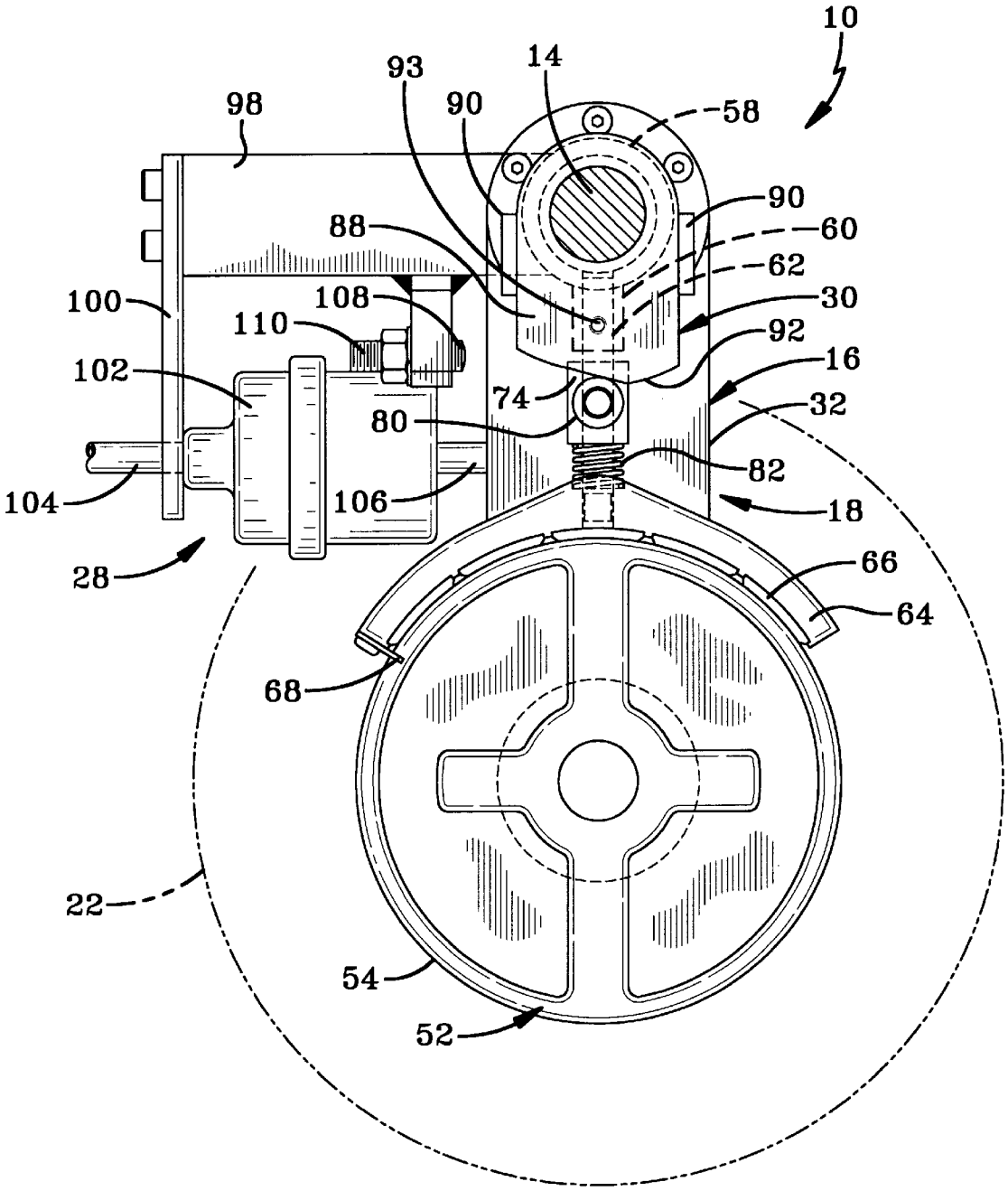
FIG. 3 is a cross-sectional view of the tension control device taken substantially along line 3—3 of FIG. 2, particularly showing elements of the braking assembly.

An exemplary self-compensating filament tension control device according to the concepts of the present invention is generally indicated by the numeral 10. As best seen in FIGS. 1, 2, and 6, the tension device 10 includes a frame support 12 from which a fixed shaft 14 integrally extends. The frame support 12 may be part of a creel or other support structure which is part of a machine that processes individual strands of filamentary material into a finished manufactured item. It will be appreciated that the frame support 12 may also be employed to support multiple devices 10 as needed.

A swing frame assembly, generally indicated by the numeral 16, is pivotably mounted upon a distal end of the fixed shaft 14. Also pivotably mounted upon the fixed shaft 14 is a braking assembly generally indicated by the numeral 18. The braking assembly 18 is shown positioned between the swing frame assembly 16 and the fixed support 12. A spindle assembly, generally indicated by the numeral 20, carries a spool 22 which is shown in phantom. The spool 22 has wound thereon filamentary material 24, such as wire, yarns, threads, and the like, that are removed from the spool 22 for use in a finished end product. When rotational forces are applied to the spool 22, as a result of the tension force applied to the filamentary material 24, the swing frame assembly 16 and the braking assembly 18 pivot about the fixed shaft 14. A loading assembly, generally indicated by the numeral 28, is fixably carried by the fixed shaft 14. In other words, the loading assembly 28 is not rotatable about the fixed shaft 14. The loading assembly 28 is operatively coupled to the swing frame assembly 16 to impart a predetermined load or balancing force to the swing frame assembly and the braking assembly 18. The interaction between the loading assembly 28 and the swing frame assembly 16 will be discussed in detail hereinbelow. A cam, generally indicated by the numeral 30, is operatively coupled to the braking assembly 18.

As will be further appreciated from the detailed description to follow, the swing frame assembly 16, the braking assembly 18, the spindle assembly 20, the loading assembly 28, and the cam 30 coact to control the payout or letting off of the filamentary material 24 from the spool 22. The device 10 provides a compact mechanism for running off the filamentary material in a straight flow path which then continues to an organizing system and/or calender. As the filamentary material is let off from the spool 22, the diameter of the filamentary material wound about the spool becomes smaller and the tension acting on the swing frame assembly 16 causes a braking force normally applied by the braking assembly 18 to be relieved by an increasing amount, thereby tending to keep the filament tension constant. The particular aspects of each of the major components will now be discussed in turn.

The swing frame assembly 16 includes a pair of opposed arms 32 rotatably mounted on the fixed shaft 14. In particular, a pair of ball or anti-friction bearings 34 are disposed between the fixed shaft 14 and the pair of opposed arms 32. A pivotable nose 36 connects the pair of opposed arms 32 to one another and is coupled to the loading system 28. The pivotable nose 36 is connected to the pair of opposed arms 32 so that both arms 32 pivot in a like manner. Attached to each end of the arms 32, opposite the fixed shaft 14, is a carriage 38 which has an anti-friction bearing 40 disposed within each end thereof.

The spindle assembly 20 includes a spindle 44 which is rotatably received in the carriage 38 and, in particular, is rotatable by virtue of contact with the anti-friction bearings 40. The spindle 44 includes a tapered end 46 to receive the spool 22. A spool stop 48 is fixed to the spindle and rotates therewith and is positioned between the tapered end 46 and the carriage 38. A drive pin 50 is cantilevered from the spool stop 48 at a position radially removed from the spindle 44. The drive pin 50 engages the spool 22 which causes the spindle 44 to rotate as the spool rotates. In other words, as tension is applied to the filamentary material 24 and withdrawn from the spool 22, the rotational force moment applied to the spool is transferred to the spindle 44 by the drive pin 50 through the spool stop 48. A brake drum 52 is affixed to the other end of the spindle 44 and provides a brake surface 54 about the outer periphery thereof.

The braking assembly 18 is interposed between the fixed shaft 14 and the brake drum 52. Since the braking assembly 18 is coupled to the brake drum 52 and pivotably mounted upon the fixed shaft 14, it will be appreciated that the braking assembly 18 pivots with the swing frame assembly 16 when any forces are applied thereto. The braking assembly 18 includes a restraining bracket 58 that is rotatably carried by the fixed shaft 14. The restraining bracket 58 includes a collar 60 which slidably receives a pin 62. The opposite end of the pin 62 is attachably fixed to a brake shoe 64 which extends about a portion of the brake surface 54. The brake shoe 64 carries a plurality of friction pads 66 which are engagable with the brake surface 54. A rim 68 extends from the brake shoe 64 to maintain alignment of the braking assembly 18 upon the brake drum 52. Those skilled in the art will appreciate that the brake shoe 64 could be replaced with a retaining band which is secured to the braking assembly 18 in a manner well known in the art. A block 74 has a pin hole 75. The block 74 also has a cross hole 76 that slidably receives a cross pin 78. The cross pill 78 has a transverse hole 79 that is alignable with the pin hole 75. As such, the block 74 and cross pin 78 are slidably movable on the pin 62. The cross pin 78 is held in place in the block 74 by a cam bearing 80 attached to each end thereof. A spring 82 is received on the pin 62 such that one end of the spring 82 bears against the block 74 while the opposite end of the spring bears against the brake shoe 64. A slidable sleeve 84 is diametrically disposed between the spring 82 and the outer diameter of the pin 62 and is sized to be somewhat shorter than the length of the spring 82 in an uncompressed condition. Accordingly, when the spring 82 is compressed a predetermined amount, the sleeve 84 comes in contact with a bottom edge of the block 74 and the top edge of the brake shoe 64 such that a braking force is fully applied to the braking surface 54.

The cam 30 is carried by the fixed shaft 14 and is secured thereto. As best seen in FIG. 2, the cam 30 has a pair of opposed plates 88 which are interconnected by a pair of cross bars 90. The opposed plates 88 are disposed upon the fixed shaft 14 such that the restraining bracket 58 is disposed therebetween. The ends of the opposed plates 88 opposite the fixed shaft 14 each provide a curvilinear camming surface 92 that engages a corresponding rotatable cam bearing 80. The plate 88 adjacent the fixed support has a threaded opening 93. A screw or other fastening device 94 is employed to connect the fixed support 12 to the opposed plate 88 with the opening 93. This functions to further secure the cam 30 to the fixed shaft 14. This precludes any pivotable movement from the braking assembly 18 to be imparted to the cam 30 and as such, the cam is fixed and stationary upon the shaft 14.

As best seen in FIG. 6, the frame support 12 may be provided with a clearance pocket 95. Within the pocket 95, a curved slot 96 is provided. This allows selective positional adjustment of the cam 30, and in particular, the camming surfaces 92 with respect to the cam bearings 80. The threaded shaft of the screw 94 extends through the slot 96 for attachment to the threaded opening 93. The head of the screw 94 bears against the clearance pocket 95 when tightened. A spacer 97 is provided between the frame support 12 and the adjacent plate 88. The screw 94 passes through the spacer and is secured to the plate 88.

The loading system 28 includes a bracket 98 that is fixed to and cantilevered from the shaft 14. In this embodiment, the bracket 98 is shown positioned between the opposed arms 32 of the swing frame assembly 16. It will be appreciated by those skilled in the art that the bracket 98 could be mounted to the fixed support 12 or any other fixed immovable structure. In any event, a mounting bar 100 extends substantially perpendicularly downward from the bracket 98 and carries an air cylinder 102 at an opposite end. It will be appreciated that any other constant-force applying device such as a hydraulic piston or electrically powered motor could be secured to the mounting bar 100. In this embodiment, the air cylinder 102 provides a hose 104 to receive a supply of regulated air. A piston rod 106 extends from the air cylinder 102 and is attached to the pivotable nose 36. When the piston rod 106 is fully extended, the swing frame assembly 16 and the braking assembly 18 move away from the mounting bar 100. It is the primary purpose of the loading system 28 to apply a predetermined balancing force in a direction opposite the tension applied to the filamentary material 24. In the preferred embodiment, it has been determined that air pressure of about 0 to 1 bar psi is sufficient for imparting a loading force to the swing frame assembly 16.

A set stop 108 extends downwardly from the mounting bar 100 and provides an adjustable set screw 110 which precludes any over travel of the swing frame assembly 16 in the event of an excessive tension force applied to the filamentary material carried by the spool 22.

Figure 4:
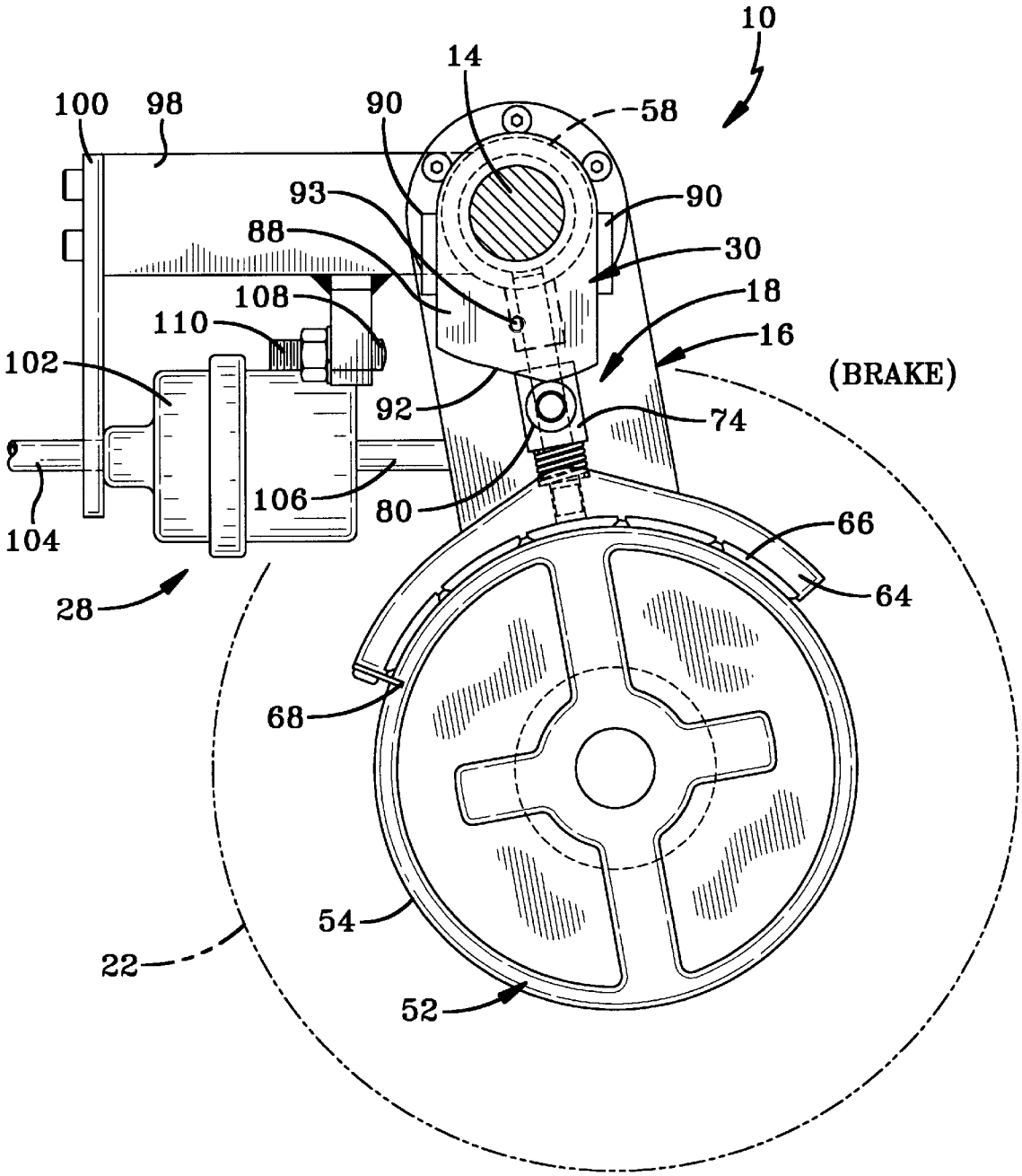
FIG. 4 is a view similar to FIG. 3, but showing the tension control device in a full braking position.

In operation, the spool 22 with filamentary material 24 wound thereupon is mounted upon the spindle 44 and the drive pin 50 is engaged. The person loading the spool 22 onto the device 10 will then pull the filamentary material through a guide or calendar whereupon it is received in a machine that will apply a tension force thereto as it pulls the filamentary material for use in an end product. Once the preliminary connection is made between the end of the filamentary material and the end process, the predetermined loading force is applied by the air cylinder 102 in a direction opposite the tension force applied by the filamentary material. Accordingly, both the swing frame assembly 16 and the braking assembly 18 are pivoted upon the shaft 14 in a direction opposite the tension force. As best seen in FIG. 4, the spool 22 is pivoted in a slightly counter-clockwise direction such that the cam 30 fully engages the braking assembly 18. In particular, the curvilinear camming surface 92 exerts or displaces the rotatable cam bearings 80 as far as possible. Exertion of this force by the camming surface 92 causes rotation of the cam bearings 80 and forces the cross pin 78 and the block 74 downwardly toward the spring 82. Accordingly, the block 74 exerts a downward pressure on the spring 82 and the brake shoe 64 such that the friction elements 66 fully engage the braking surface 52 to preclude rotatable movement of the spindle 44 and of course, the spool 22.

Figure 5:
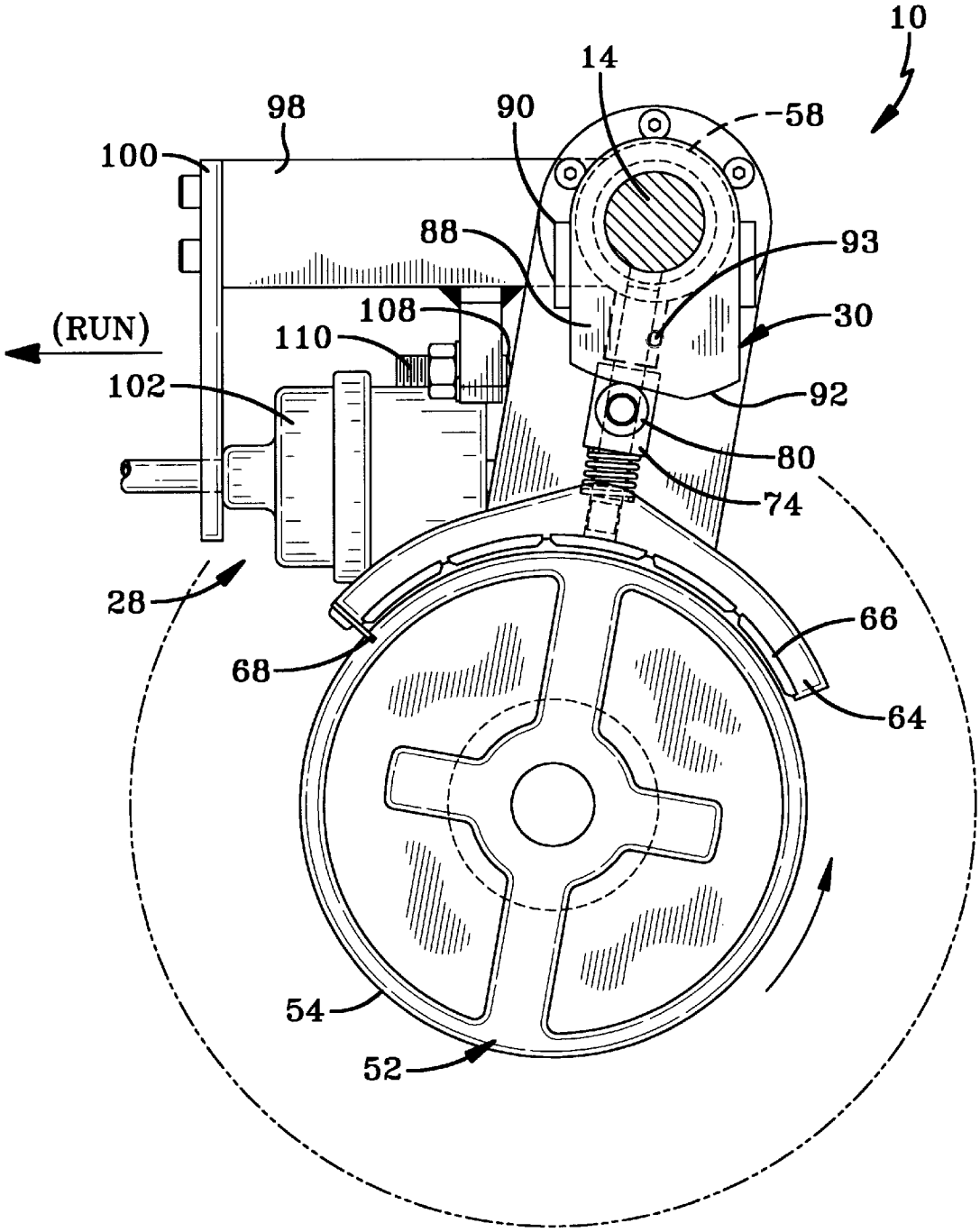
FIG. 5 is a view similar to FIG. 3, but showing the tension control device in a full running condition.

As a tension force is applied to the filamentary material, the predetermined loading force exerted by the air cylinder 102 begins to be overcome. This tension force is also required to pivotably move the swing frame assembly 16 and the braking assembly 18 in a clockwise direction about the fixed shaft 14. As a result, the cam bearings 80 are moved to a less extreme position upon the curvilinear camming surface 92 so as to relax the force applied by the block 74 upon the spring 82. This allows somewhat free rotation of the spool 22 and withdrawal of the filamentary material therefrom as best seen in FIG. 5. The adjustable set stop 108 is employed to stop over-travel of the swing frame assembly 16 in the event excessive tension force is applied to the filamentary material.

As the tension applied to the filamentary material varies, for example, when the moment arm from the fixed shaft 14 increases, the rotation of the spindle 44 is easily regulated. In other words, as the spool of material unwinds, the torque created by the tension force acting on the swing frame assembly 16 tends to increase, thereby further relieving the spring pressure acting on the brake shoe 64. In the event the tension applied to the filament is immediately removed or significantly reduced, it will be appreciated that the air cylinder, which applies its predetermined constant loading force through the swing frame assembly 16 and braking assembly 18, will cause the swing frame assembly and braking assembly to pivot counterclockwise (as seen in FIG. 4) about the fixed shaft 14 and engage the brake shoe 64 upon the drum 52.

Based upon the foregoing, it will be appreciated that there are numerous advantages to the present invention. In the device 10, there is no need for a separate control arm or roller to assist in the guidance of the filamentary material. As such, the spool material is drawn directly from the spool 22. Since there is no separate control arm or roller, the device is less vulnerable to damage from over-tension possibly caused by entanglement of the spool of material. Since the material is pulled directly from the spool without passing over a roller mounted control arm, it is not imparted with a cast or distortion thereto. This has been found to be particularly advantageous when pulling heavy wire gage material.

Thus, it should be evident that the disclosed device carries out the objects of the invention set forth above. As apparent to those skilled in the art, modifications can be made without the departing from the spirit of the invention herein disclosed and described, the scope of the invention being limited solely by the scope of the attached claims.

What is claimed is:

1. A tension control device for regulating the payout of filamentary material from a spool, comprising:

a fixed support;

a swing frame assembly pivotably mounted on said fixed support and predisposed to a holding position;

a spindle assembly carried by said swing frame assembly, said spindle assembly carrying the spool and rotating with the spool as the filament is pulled off the spool;

a braking assembly pivotably mounted on said fixed support and movable with said swing frame assembly; and a cam fixably mounted on said fixed support and bearing against said braking assembly and forcing said braking assembly to control the rotation of said spindle assembly wherein a pull-off force applied by filamentary material causes said swing frame assembly to move away from said holding position and allow rotation of said spindle assembly.

2. The device according to claim 1, further comprising:

a loading assembly fixably mounted on said fixed support for positioning said swing frame assembly and said braking assembly to said holding position.

3. The device according to claim 2, wherein said swing frame assembly comprises:

a pair of opposed arms rotatably mounted on said fixed support at one end; and a carriage interconnecting the other ends of said opposed arms, said carriage rotatably receiving said spindle assembly.

4. The device according to claim 2, wherein said spindle assembly comprises:

a spindle rotatably carried by said swing frame assembly, one end of said spindle having an end for receiving the spool and an opposite end for carrying a brake drum;

a spool stop integral with said spindle;

a drive pin extending from said spool stop to engage the spool, wherein rotation of the spool is caused by any tension applied by the filamentary material which causes pivotable movement of said swing frame assembly which causes disengagement between said cam and said braking assembly and imparts a corresponding rotational force to said brake drum to allow regulated rotation of said spindle.

5. The device according to claim 2, wherein said braking assembly comprises:

a restraining bracket rotatably mounted on said fixed support, said restraining bracket having a collar;

a pin slidably received in said collar;

a brake shoe secured to an opposite end of said pin for engaging said spindle assembly, wherein pivotable movement of said swing frame assembly is transferred by said spindle assembly to said brake shoe, said pin and said restraining bracket; and cam bearings mounted on said pin and engaging said cam which imparts a braking force on said brake shoe when said swing frame assembly is in said holding position and which relieves said braking force when said swing frame assembly is moved away from said holding position.

6. The device according to claim 5, wherein said braking assembly further comprises a spring slidably received on said pin and interposed between said brake shoe and said cam bearings.

7. The device according to claim 2, wherein said cam comprises:

at least one plate fixably mounted on said fixed support at one end, said at least one plate having a camming surface at an opposite end to engage said braking assembly.

8. The device according to claim 2, wherein said loading system comprises:

a bracket extending from said fixed support; and an air cylinder carried by said bracket and receiving a supply of air for exerting a predetermined loading force on said swing frame, wherein said loading force is selected to be overcome by the tension force required to withdraw the filamentary from the spool.

9. A self-compensating tension control device for regulating the payout of filamentary material from a spool, comprising:

a fixed support;

a pivotable spindle assembly mounted directly to and suspended from said fixed support, said spindle assembly rotatably carrying the spool of filamentary material, wherein a pull-off force imparted by the filamentary material causes rotation of said spindle assembly and pivotable movement thereof; and a pivotable braking assembly mounted directly to and suspended from said fixed support and coupled to said spindle assembly and pivotable therewith, said braking assembly stopping the rotation of the spool when the pull-off force is below a predetermined threshold, wherein reduction of the pull-off force causes simultaneous pivotable movement of said stindle assembly and said braking assembly so that said braking assembly applies a corresponding braking force to said spindle assembly.

10. The device according to claim 9, further comprising:

a cam fixably mounted on said fixed support, said cam engaged by said braking assembly when the pull-off force is below the predetermined threshold and at least partially disengaged when the pull-off force is at or above the predetermined threshold.

11. The device according to claim 10, further comprising:

a loading assembly fixably mounted to said fixed support, said loading assembly coupled to one of said spindle assembly and said braking assembly and imparting the predetermined threshold thereto.

12. The device according to claim 11, wherein said loading assembly includes an air cylinder which allows selective adjustment of the predetermined threshold.

13. The device according to claim 11, wherein said spindle assembly includes a brake drum rotatable therewith, said brake drum having a braking surface engaged by said braking assembly.

14. The device according to claim 13, wherein said braking assembly comprises:

a restraining bracket pivotably mounted to said fixed support, said restraining bracket having a collar;

a pin having one end slidably received in said collar;

a block having a pin hole therethrough;

a cross pin having a transverse hole therethrough alignable with said pin hole, said pin slidably received through said cross hole and said pin hole;

a cam bearing rotatably mounted to each end of said cross pin for securing said block to said pin;

a brake shoe affixed to said pin opposite said restraining bracket;

a spring slidably received on said pin and interposed between said block and said brake shoe; and said cam bearings engaged by said cam, such that as said spindle assembly and said brake assembly are pivoted, said cam slidably moves said cam bearings such that the force exerted by said block and said spring adjusts the force applied by said brake shoe on said brake drum.

15. The device according to claim 14, further comprising:

a set stop to preclude over travel of said spindle assembly and said braking assembly.

16. The device according to claim 14, wherein said braking assembly further comprises:

a stop sleeve slidably disposed between said spring and said pin and positioned between said block and said brake shoe to preclude application of excessive force to said brake shoe.

17. A self-compensating tension control device for regulating the payout of filamentary material from a spool, comprising:

a fixed support;

a spindle assembly pivotably mounted to said fixed support, said spindle assembly rotatably carrying the spool of filamentary material, wherein a pull-off force imparted by the filamentary material causes rotation of said spindle assembly and pivotable movement thereof;

a braking assembly pivotably mounted to said fixed support and coupled to said spindle assembly and pivotable therewith, said braking assembly stopping the rotation of the spool when the pull-off force is below a predetermined threshold; and a cam fixably mounted on said fixed support, said cam engaged by said braking assembly when the pull-off force is below the predetermined threshold and at least partially disengaged when the pull-off force is at or above the predetermined threshold.

* * * * *

UNITED STATES PATENT AND TRADEMARK OFFICE

CERTIFICATE OF CORRECTION

PATENT NO. : 6,098,910

DATED : August 8, 2000

INVENTOR(S) : Raymond J. Slezak

It is certified that error appears in the above-indentified patent and that said Letters Patent is hereby corrected as shown below:

On the cover page of the patent, at item [73], "Wayne-Dalton Corp., Mt. Hope, Ohio" should read -RJS Corporation, Akron, Ohio-.

Signed and Sealed this

First Day of May, 2001

Nicholas P. Godici

*Attest:*

NICHOLAS P. GODICI

*Attesting Officer*

*Acting Director of the United States Patent and Trademark Office*